US006989798B2

(12) United States Patent
Wu

(10) Patent No.: US 6,989,798 B2
(45) Date of Patent: Jan. 24, 2006

(54) ANTENNA AND FIXED BASE ROTARY POSITIONING STRUCTURE

(75) Inventor: Wen-Ching Wu, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 217 days.

(21) Appl. No.: 10/724,061

(22) Filed: Dec. 1, 2003

(65) Prior Publication Data

US 2005/0116877 A1 Jun. 2, 2005

(51) Int. Cl.
*H01Q 1/12* (2006.01)

(52) U.S. Cl. ..... 343/878

(58) Field of Classification Search ..... 343/882, 343/880, 878, 881, 713, 711, 900
See application file for complete search history.

(56) References Cited

U.S. PATENT DOCUMENTS 5,252,985 A * 10/1993 Christinsin ..... 343/880
5,451,966 A * 9/1995 Du et al. ..... 343/715
2001/0050649 A1 * 12/2001 Wang ..... 343/715

* cited by examiner

*Primary Examiner*—Hoang V. Nguyen
*Assistant Examiner*—Angela M Lie
(74) *Attorney, Agent, or Firm*—Bacon & Thomas PLLC

(57) ABSTRACT

The present invention discloses an antenna with a fixed base rotary positioning structure, which can be placed on a table or hung on a wall, comprising: a fixed base; a protrusion disposed on the fixed base and having an open end on one side; a chamber enclosed by the rest of three sides; a pivotal axial hole and an arc groove being correspondingly disposed on both sides of the inner wall of the protrusion, such that the pivotal axial hole and the arc groove precisely and pivotally coupling the pivotal axis and the protruded fixing point to the two corresponding sides at one end of the antenna, and the antenna using such pivotal axis as the rotary axis to adjust the antenna to any angle by the open end of the protrusion.

7 Claims, 3 Drawing Sheets

ANTENNA AND FIXED BASE ROTARY POSITIONING STRUCTURE

BACKGROUND OF THE INVENTION

1. Field of the Invention

This invention relates to an antenna, more particularly to an antenna with a fixed base rotary positioning structure.

2. Description of the Related Art

As the present society fills up with information and knowledge, information exchange and communications between people have become more important day after day. While the network and communication technologies such as Internet, mobile communications, and wireless communications are developed and widespread in a fast phase. Wireless devices serve as the advanced communications tools, playing an important role in our daily work and life as well as giving an indispensable effect. However, a general wireless network device usually requires an antenna, which is a well-known art, for being used to effectively transmit and receive signals. Therefore, users can use any wireless network device to transmit or receive signals between wireless network devices via the visiting node of the wireless network, so that users can use wireless network devices to contact with the outside by means of the wireless network devices, and obtain the maximum effect within the shortest possible time.

In general, most conventional antennas have a base body, and a slim antenna fixed on the base body, such that the base body is set on the table and provided for the wireless network device to transmit and receive the wireless network device, and thus users can use the wireless network device to contact with the outside anytime anywhere.

In view of the blooming wireless network devices and actual user's demands, the inventor of this invention believed that a single base body and an antenna no longer can satisfy the requirements. That is, the prior-art fixed antenna can only be placed on a table for its application. In the meantime, the base and the antenna are limited by the fixed status, and thus the antenna cannot be adjusted to any angle freely. Further, the wire extended from the body of the antenna cannot be handled properly, which takes up too much space for the application without much flexibility, and even causes damages to the base and antenna due to the fixed connection, and further affects the effects of sending and receiving signals by the wireless network device.

Therefore, the inventor of this invention improved the design of the prior-art fixed antenna and its base according to the actual needs, such that the main body of the antenna not only can be rotated to adjust the angle and fixed into a position, but also can be set on a table or hanged onto the wall to solve the abovementioned problems, and make the application more convenient. Such arrangement not only greatly helps to improve the sales of the wireless network device manufacturers, but also benefits the extensive consumers. Thus, the research and development of a multifunctional product for the wireless device industry is an important urgent subject.

SUMMARY OF THE INVENTION

In view of the description above, the prior-art antenna and base are fixed, which cannot be adjusted to any angle at will, but can only be set on a table for use. Thus, the prior-art antenna and base cause all kinds of inconvenience. Based on the actual need of the market and users, the inventor of this invention conducted extensive researches and developments and experiments to develop "an antenna with a fixed base rotary positioning structure" to enhance the add-on value.

The primary objective of the present invention is to provide an antenna with a fixed base rotary positioning structure, which can be placed on a table or hung on a wall, comprising: a fixed base; a protrusion disposed on the fixed base and having an open end on one side; a chamber enclosed by the rest of three sides; a pivotal axial hole and an arc groove being correspondingly disposed on both sides of the inner wall of the protrusion, such that the pivotal axial hole and the arc groove precisely and pivotally coupling the pivotal axis and the protruded fixing point to the two corresponding sides at one end of the antenna, and the antenna using such pivotal axis as the rotary axis to adjust the antenna to any angle by the open end of the protrusion. In the meantime, the antenna can be moved along the arc groove and fixed by the protruded fixing point, and the antenna can be fixed on to a wall by at least one hanging hole disposed at the bottom of the fixed base.

The secondary objective of this invention is to provide a linear groove being extended from one of the two corresponding inner walls where the protrusion is coupled to the fixed base, such that a linear member is disposed on the antenna at the pivotal end of the protrusion, and being extended to the outside from one end by means of the positioning of the linear line of the linear groove.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
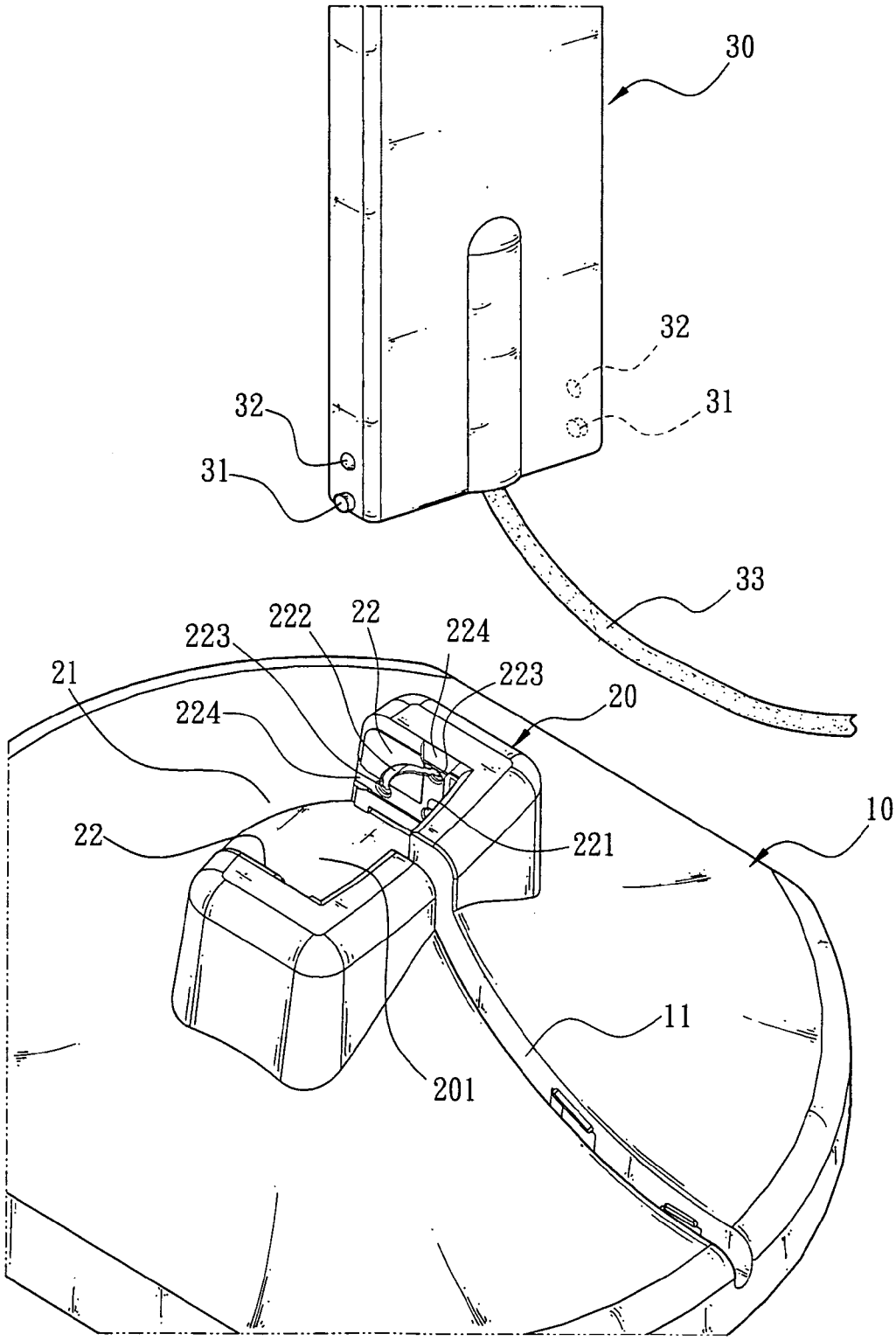
FIG. 1 is a perspective diagram of the some disassembled parts of the structure of the present invention.

To make it easier for our examiner to understand the objective of the invention, its structure, innovative features, and performance, we use a preferred embodiment together with the attached drawings for the detailed description of the invention. Please refer to FIGS. 1 and 3 for the "antenna with a fixed base rotary positioning structure" in accordance with present invention, comprising a fixed base 10, a protrusion 20, and an antenna 30, wherein the fixed base 10 stably erects on a table or other fixed object (such as hanging on a wall). In FIG. 1, the protrusion 20 is disposed on fixed base 10, and the cross section of the protrusion is substantially U-shape, and one side of the protrusion 20 is an open end on one side, and the rest three sides are successively connected to enclose a chamber 201. Please refer to FIGS. 1 and 2, a pivotal axial hole 221 and an arc groove 222 are respectively disposed on two corresponding inner walls 22 of the protrusion 20, wherein the arc groove 222 is extended from the center of the pivotal axial hole 221 to a predetermined distance.

Figure 2:
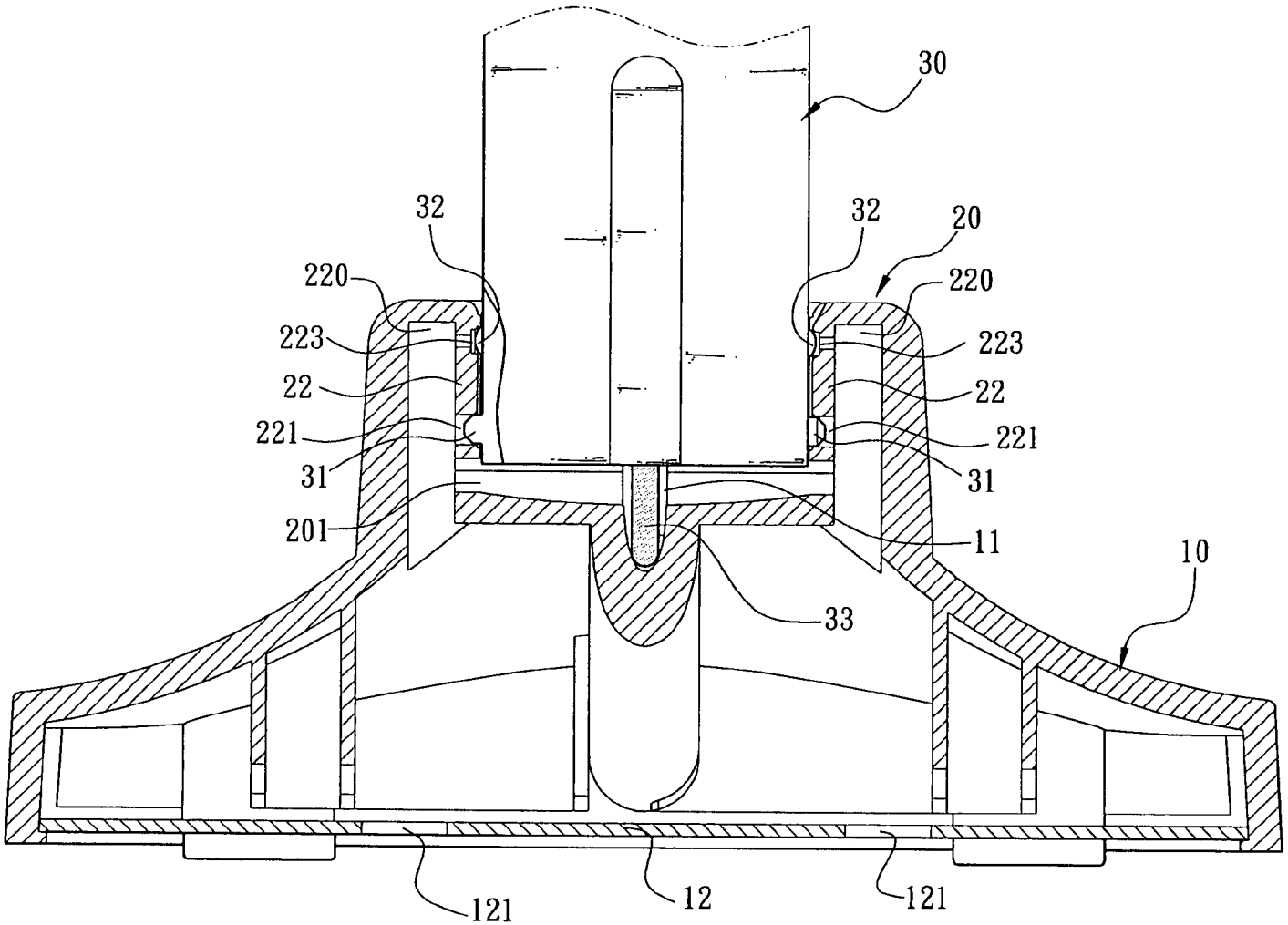
FIG. 2 is a cross-sectional diagram of some components of the present invention.
Figure 3:
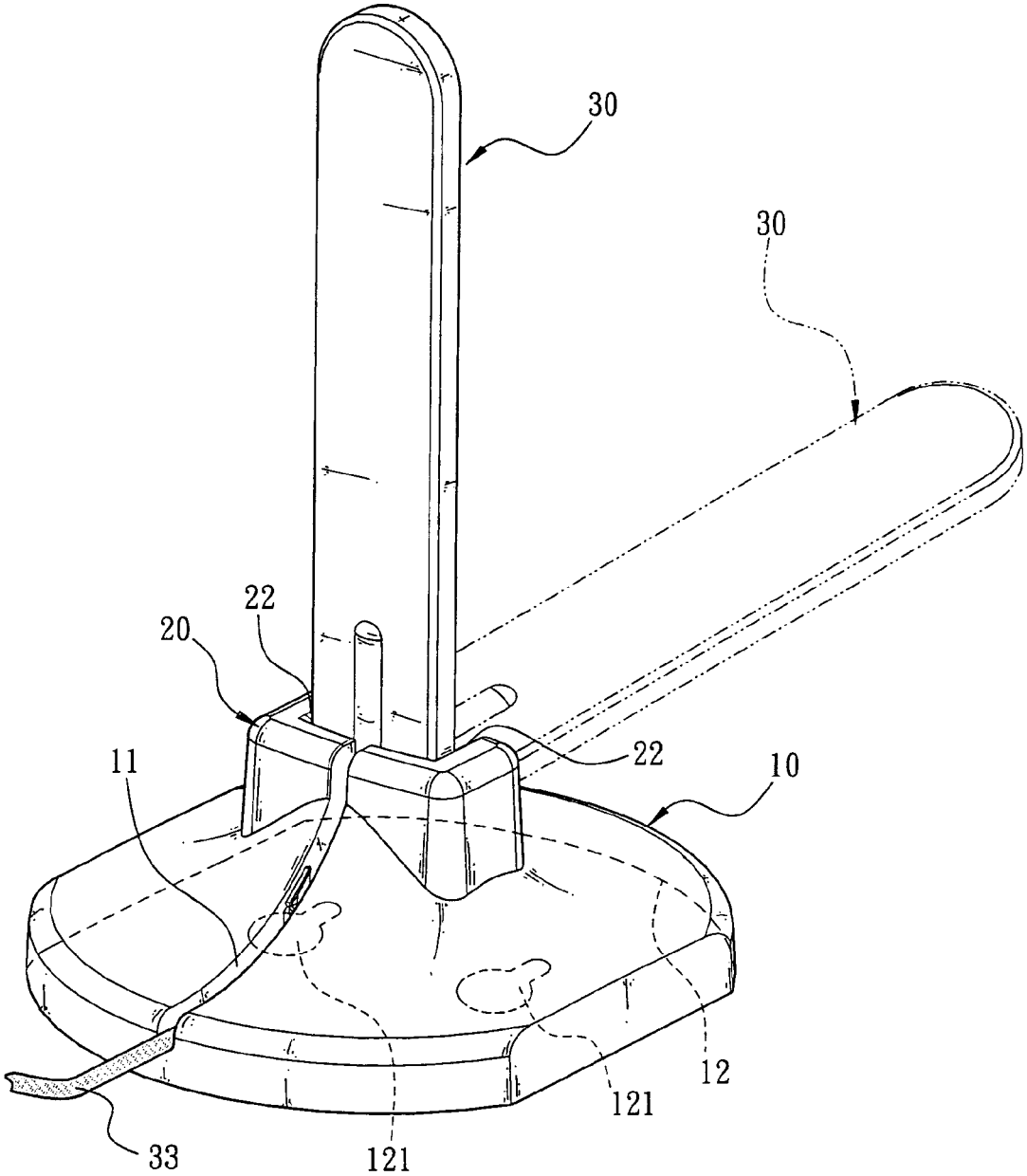
FIG. 3 is a perspective diagram of the movement of assembling the present invention.

Further, the antenna 30 is substantially in a bar shape. In FIGS. 2 and 3, the antenna 30 having a cross section substantially in the shape of a bar that works together with the chamber 201 of the protrusion 20. However, the embodiment of this invention is not limited to this shape, and could be a cross section in any other shape that can collocate with the shape of the chamber 201. Please refer to FIGS. 1 and 2 again. In the figures, a pivotal axis 31 and a protruded fixing point 32 are disposed respectively on both corresponding sides at one end of the antenna 30, and the pivotal axis 31 and the protruded fixing point 32 are pivotally coupled to the pivotal axial hole 221 and the arc groove 222 disposed on two corresponding inner walls 22 of the protrusion 20, such that the antenna 30 can use the pivotal axis 31 as the rotary axis to turn and adjust the open side 21 of the protrusion to any angle (from 0 degree to 90 degrees as shown in FIG. 3). In the meantime, the protruded fixing point 32 moves and fix the antenna 30 along the arc groove 222 into a position.

In a preferred embodiment of the present invention, a fixing hole 223 (as shown in FIG. 1) is disposed respectively on both end points of the arc groove 222, such that after the protruded fixing point 32 of the antenna 30 moves to the fixing hole 223, the protruded fixing point 32 can be fixed into a position that makes the antenna 30 being horizontal or vertical to the fixed base 10 (as shown in FIG. 3). However, the preferred embodiment of this invention is not limited to this. A plurality of fixing holes 223 disposed on the arc groove 222 can be used to provide a multiple of angles and fixing after the protruded fixing point 32 of the antenna 30 is moved into the fixing hole 223.

Please refer to FIG. 2 for a preferred embodiment of the present invention. Both inner walls of the protrusion 20 have a hollow 220, which provides an elastic clamping feature to both inner walls 22, such that the protruded fixing point 32 of the antenna 30 can be clamped effectively onto the two inner walls 22 of the protrusion 20 to make the movement of the protruded fixing point 32 smoother.

Further, an aslant groove 224 (as shown in FIG. 1) each extending outward to a horizontal or a vertical direction from the center of the pivotal axial hole 221 on both inner walls 22 of the protrusion 20, so that the aslant grooves 224 facilitates the placement of the pivotal axis 31 and the protruded fixing point 32 of the antenna 30 into the pivotal axial hole 221 and the fixing holes 223 of the arch groove 222.

A linear member 33 (as shown in FIGS. 1, 2, and 3) extended outward from the end where the antenna 30 and the protrusion 20 are pivotally coupled, and a linear groove 11 being disposed on a position where the protrusion 20 connects one of its two corresponding inner walls 22 and extends to the fixed base 10, such that the linear member 33 uses the linear positioning of the linear groove 11 to extend one end outside.

Further, the bottom of the fixed base 10 has an iron plate 12 (as shown in FIGS. 2 and 3) for securing the fixed base 10 on the tabletop, and the iron plate 12 has at least one hanging hole 121 for hanging the fixed base 10 onto a wall. In the meantime, the antenna 30 can be adjusted to an appropriate angle according to the requirement of the actual space.

By means of the foregoing components, it is clear that the fixed base 10 and antenna 30 can be secured on the tabletop, or hung on a wall by the hanging hole 121 at the bottom of the fixed base 10. In the meantime, the antenna 30 can be inserted into the pivotal axial hole 221 and the arc groove 222 of the protrusion 20 by the pivotal axis 31 and the protruded fixing point 32 respectively according to the actual requirement. The open side 21 of the protrusion 20 can adjust the antenna 30 to an angle and fixed it into a position, so that the linear member 33 of the antenna 30 can freely move in the linear groove 11.

Therefore, the major characteristic of this invention resides on that the protrusion 20 on the fixed base 10 has a rotary positioning structure to effective adjust and rotate the antenna 30 to an appropriate angle for the positioning effect according to the actual space requirement, and thus maximizing the effect of the fixed base 10 and the antenna 30. In the meantime, the design of this invention not only has the advantage of simple structure, but the overall design also can fix the fixed base 10 and the antenna 30 on the table or hang the antenna 30 on a wall. Such arrangement can effectively overcome the shortcomings of the traditional antenna, and this invention definitely complies with the humanistic design.

While the present invention has been described by the most practical and preferred embodiments, it is understood that this invention is not limited to the disclosed embodiments but is intended to cover various arrangements included within the spirit and scope of the broadest interpretations and equivalent arrangements.

What is claimed is:

1. An antenna with a fixed base rotary positioning structure, comprising:

a fixed base, being securely erected on a tabletop or a fixed object;

a protrusion, with an U-shape cross section, being disposed on said fixed base, and having one open side, and the rest three sides mutually connected to enclose a chamber, and the two corresponding sides of said protrusion respectively having a pivotal hole and an arc groove;

an antenna, substantially in a bar shape and precisely fitting into said chamber, such that both corresponding sides at one end of the said antenna respectively comprising a pivotal axis and a protruded fixing point, and said pivotal axis and protruded fixing point being pivotally coupled to the pivotal axial hole and arc groove on both inner walls of said protrusion, thereby the pivotal axis of said antenna being used as the rotary axis to rotate and adjust said antenna to an appropriate angle by the open side of said protrusion, and said protruded fixing point moving and fixing said antenna in said arc groove to a fixed position.

2. The antenna with a fixed base rotary positioning structure of claim 1, wherein said arc groove at both end points, each comprises a fixing hole, so that after the protruded fixing point of said antenna being moved to said fixing hole for securing said antenna into a fixed position selected one from a collection of horizontal and vertical angles.

3. The antenna with a fixed base rotary positioning structure of claim 2, wherein said fixing hole collocates a plurality of fixing hole disposed on said arc groove to provide a multiple of angle and positioning after the protruded fixing point of said antenna being moved to said fixing hole.

4. The antenna with a fixed base rotary positioning structure of claim 1, wherein said two inner walls of said protrusion are hollows thereby providing an elastic clamping feature for said two inner walls, and the protruded fixing point of said antenna effectively clamping said two inner walls of said protrusion to provide a smooth movement for said protruded fixing point.

5. The antenna with a fixed base rotary positioning structure of claim 4, wherein said two inner walls of said protrusion use said pivotal hole as the center to extend an aslant groove in a direction selected one from the collection of vertical and horizontal directions to facilitate the disposition of said pivotal axis and protruded fixing point on two sides of said antenna into the fixing holes of said pivotal axial hole and said arc groove respectively.

6. The antenna with a fixed base rotary positioning structure of claim 1, wherein said antenna and protrusion comprise a linear member at the pivotal connecting end, and a linear groove disposed at the position where one of the two walls of said protrusion extends onto said fixed base, thereby said linear member is fixed into a position by said linear groove with one end extending outward.

7. The antenna with a fixed base rotary positioning structure of claim 1, wherein said fixed base at its bottom comprises an iron plate which has at least one hanging hole for hanging said fixed base on a wall, and said antenna is rotated and adjusted to an appropriate angle according to the actual requirement of the space.

* * * * *